United States Patent [19]

Cash et al.

[11] Patent Number: 4,549,856

[45] Date of Patent: Oct. 29, 1985

[54] COMPRESSOR CONTROL SYSTEM

[75] Inventors: John Cash; John A. Kitchener, both of Richmond, Australia

[73] Assignee: Cash Engineering Co. Pty. Ltd., Richmond, Australia

[21] Appl. No.: 585,787

[22] Filed: Mar. 2, 1984

[30] Foreign Application Priority Data

Apr. 8, 1983 [AU] Australia ..... PF8807

[51] Int. Cl.[4] ..... F04C 29/08; F04C 18/16

[52] U.S. Cl. ..... 417/295

[58] Field of Search ..... 417/295, 442, 278

[56] References Cited

U.S. PATENT DOCUMENTS

| | | | |
|---|---|---|---|
| 3,072,319 | 1/1963 | Cox et al. . | |
| 3,602,610 | 8/1971 | Bloom | 417/295 X |
| 3,860,363 | 1/1975 | Silvern | 417/295 X |
| 4,068,980 | 1/1978 | Fine et al. | 417/295 X |
| 4,089,623 | 5/1978 | Hofmann | 417/295 |

FOREIGN PATENT DOCUMENTS 1415936 12/1975 United Kingdom .

*Primary Examiner*—Richard E. Gluck

*Attorney, Agent, or Firm*—Bell, Seltzer, Park & Gibson

[57] ABSTRACT

A control valve configuration for a compressor system comprises a compressor receiving gas and liquid lubricant for compression and delivery to a separator where the compressed gas is separated from the liquid and passed to an end use with the liquid being recycled to through the compressor. The control valve configuration is arranged to control flow through the gas inlet to the compressor in response to demands of the compressor system and mechanisms are provided to supply pressurized gas to the inlet zone of the compressor upon the valve configuration moving towards a position preventing flow of gas to the compressor to thereby reduce vacuum conditions in the inlet zone thereby reducing transient noises associated with compressor operation and minimizing power consumption during no load operation.

17 Claims, 6 Drawing Figures

COMPRESSOR CONTROL SYSTEM

The present invention relates to the general field of compressors and has particular although not inclusive relevance to rotary compressors of the flooded type. More particularly the present invention relates to valving associated with such compressors and a control system therefor. The following specification refers to screw compressors. For the sake of a specific example, however, it will be apparent to those skilled in the art that the invention is applicable to other compressor systems.

A conventional screw compressor configuration comprises a screw compressor which receives gas (commonly air) at a first lower pressure (commonly ambient) through an inlet region therefor. The screw compressor will also receive a liquid lubricant (commonly oil) to the inlet region and upon passage through the compressor, the gas and liquid is intimately mixed and compressed. The compressed gas/liquid mixture is discharged at a second higher pressure to a separator vessel where the liquid and gas are separated with clean gas being subsequently used for its desired purpose. The liquid, after cooling is returned from the separator to the compressor inlet region.

A typical control system for the aforementioned type of compressor may include the following features. Firstly the compressor will normally include an inlet throttle valve regulating the gas supplied to the inlet of the compressor. This regulation may be on a fully open/fully closed basis or on an incremental (usually called modulation) basis. The control of the inlet throttle valve is effected in response to the gas pressure discharged from the separating vessel. The compressor would be started with either the inlet throttle valve open or closed, however the closed throttle start up is preferred, as it provides easier no-load starting. Considering the fully open/fully closed throttle mode of operation of the system (which is much more widely used) the throttle valve which is closed at start-up, enables an initial building up of system pressure by permitting a small amount of bleed gas to by-pass itself and this pressure build-up is retained in the closed system by a minimum pressure valve associated with the separator vessel. The minimum pressure valve is necessarily complicated and therefore expensive to produce. Once minimum pressure is reached the throttle is opened and system pressure builds up rapidly. The minimum pressure valve ensures that with an open throttle the system pressure cannot be below a pre-set level which will ensure oil circulation between the high pressure region of the separator vessel and the lower screw oil inlet pressure region. This is known as differential pressure circulation.

After system pressure overcomes this pre-set level gas is discharged out to the required end use. If the rate of use is less than the delivery rate of the compressor, system pressure will rise and at a pre-set maximum a pressure switch provided for this purpose will sense this rise and as a result the inlet throttle valve will be closed. With the inlet gas supply to the compressor cut off, the system pressure will fall until the pressure switch, on reaching a pre-set level, will re-open the inlet throttle valve to the compressor.

In the unloaded state the compressor induces air at a very low inlet pressure because with the inlet throttle valve closed and only a small amount of by-pass air reaching the screw rotors. As a result a strong vacuum is created. The compressor is then compressing gas across a very high compression ratio, (as the discharge pressure is still high). This gives rise to high unloaded power consumption with consequent high noise levels. One conventional attempt to overcome this problem involved providing the minimum pressure valve with an integral non return valve reducing the separator pressure by the provision of a pressure lowering valve. This reduced the back pressure against which the compressor had to operate and thereby substantially reduced the compression ratio. The benefits in reducing power consumption were substantial and in addition the noise levels were also greatly reduced. Often the noise level could be further reduced by increasing the amount of gas allowed to flow through the throttle by-pass thereby admitting more gas to the compressor and as a result the unloaded air inlet pressure was increased. This decreased the pressure ratio and noise but had an adverse effect of raising power consumption.

A further problem with conventional systems is that when the compressor is stopped, the high pressure in the separator has the effect of attempting to force the liquid back to the screw rotors thereby attempting to drive the compressor backwards. To prevent this happening a non return valve is provided in the discharge line from the compressor to the separator and a stop valve is placed in the liquid line returning liquid from the separator to the compressor. The stop valve must be arranged to close immediately when the compressor stops otherwise hot liquid could be ejected through the gas inlet region of the compressor with possible disastrous results. These two valves, and particularly the liquid stop valve, are under combined pressure and temperature stress and constitute a restriction to flow. In order to satisfy performance criterions these valves are expensive to construct and complicate the circuitry of the compressor system. Finally a stop dump valve is commonly also provided to dump all pressure from the system after compressor shut down.

In order to overcome the expense and the complication of the foregoing system, another alternative proposal has, on occasions, been used. In this alternative system a single non return valve is placed at the gas inlet to the compressor between the compressor and the inlet throttle valve. On stopping of the screw rotors of the compressor a slight reversal of flow in the discharge line is tolerated and this fills the compressor casing (which has a small volume compared to the separator) with pressurized gas/liquid mixture, which is contained within the system by the inlet non return valve. Unfortunately this sytem has a number of major drawbacks. Firstly the non return valve must be sized for the inlet volume flow rate which, depending on the compression ratio of the compressor, is vastly greater than the discharge volumetric flow rate (due to the compressibility of gas). This leads to a requirement for a physically very large valve. Secondly any leak in the inlet valve, on stopping of the compressor, causes a leak of liquid/gas mixture which leads to spills and worst of all, any leak causes more flow reversal and allows more liquid and gas into the compression chamber of the compressor. The liquid in particular floods the compressor and on restart causes liquid locking and subsequent poor starting to the point of momentary seizure.

If these problems could be overcome the inherent simplicity of the system would offer tangible advantages. At the same time solutions to other problems are also required, in particular the high noise levels associated with unloaded operation.

The high noise levels are caused by an instantaneous pressure rise in the discharge aperature when the in-built compression ratios of the compressor rotors are exceeded. For example, a compressor having an in-built compression ratio of 8:1 with a consequent normal discharge pressure of say 8 bars, will have a low inlet pressure of say 0.1 bar at the moment after the inlet valve has closed beginning an unloaded period of operation. The in-built compression ratio of 8:1 only compresses the air to 0.8 bar, followed by an instantaneous compression from 0.8 to 8 bar. The overall compression ratio in this situation is 80:1. The position only worsens when the discharge pressures rise. As discussed earlier, increasing the inlet pressure during unloaded operations to say 0.2 bar would halve the overall compression ratio and reduce the instantaneous pressure rise with its attendant shock waves and noise levels. This, however, increases the mass flow rate of air through the compressor and thereby the power consumption. The nature of this noise, however, is transient because as also pointed out earlier during unloaded operation the separator pressure is lowered. This too has the effect of reducing the overall pressure ratio, and once the separator is dumped the noise is no longer a problem. Unfortunately, however, the existence of the unacceptably high noise level, even though it is transient, necessitates much greater sound attenuation than would otherwise be required.

The present invention aims at providing valving means and a control system for a screw compressor arrangement which is of simple and inexpensive construction and which will avoid or minimize at least some of, and preferably all of, the aforementioned difficulties associated with conventional screw compressor arrangements.

According to the present invention provides a valve configuration for a gas inlet of a compressor, said valve configuration having a first valve element adapted to open or close a gas flow passage to the inlet region of the compressor whereby upon said first valve element moving towards a closed position, said inlet region of the compressor is connected to a source of pressurized gas to thereby reduce vacuum conditions in said inlet region caused by closing of said first valve element. Conveniently a first zone is defined on one side of said first valve element with the other side of said first valve element being adapted to engage against a first valve seat communicating with the inlet region of the compressor, said first zone being selectably communicated with a source of pressurized gas to move the first valve element against said first valve seat.

According to a first preferred embodiment the first valve element is in the form of a piston sliding within a valve body in the form of a substantially closed cylinder, said piston and said cylinder defining between them the first zone adapted for connection to said source of pressurized gas.

According to a second preferred embodiment the first valve element comprises a movable first valve member supported by a flexible diaphragm.

In either of the above two embodiments, pressure conditions may be communicated between the first zone and the inlet region of the compressor by passage means extending through the first valve element.

According to a second aspect of the present invention there is provided a valve configuration for an air inlet of a compressor, said valve configuration having a first valve element adapted to open or close an air flow passage to the inlet region of the compressor, said first valve element, upon moving towards a closed position being adapted to connect a clean air region of a separator associated with the compressor to atmosphere whereby pressure in said separator is reduced just prior to closure of the first valve element and continues to be reduced thereafter. Conveniently the first valve element is arranged to contact a valve element causing said valve element to move from a closed position to an open position upon said first valve element moving towards the closed position.

According to a third aspect of the present invention, there is provided a valving configuration for a compressor system of the type comprising a compressor adapted to compress an air/oil mixture and to discharge the compressed air/oil mixture to a separator, the separator having a clean compressed air discharge region and means for returning oil to the compressor, said valving configuration comprising a first valve means including a diaphragm valve element adapted to open or close an air flow passage to an air inlet region of the compressor, said first valve means further including passage means adapted to communicate said air inlet region of the compressor with an upstream side of said diaphragm valve element, and a fourth valve element arranged to normally close said passage means but being openable upon a predetermined pressure appearing in said air inlet region of the compressor indicative of a failure in the compressor system, whereby said predetermined pressure is applied to the upstream side of said diaphragm valve element to maintain said diaphragm valve element closed. Conveniently, the first valve means comprises a diaphragm means connected with a valve body and a surrounding valve housing whereby the valve body is adapted to close a valve seat arranged in the valve housing. Preferably the aforesaid passage means comprises a tube passing through the valve body and the fourth valve element comprises a valve member normally closing the upstream end of said tube but being movable therefrom upon said predetermined pressure being experienced at the downstream end of said tube. In accordance with a preferred arrangement, an air filter element is arranged in the air flow passage surrounding the upstream side of the first valve means.

Throughout this specification the terminology "oil" has been used to identify the liquid type lubricant medium used in a flooded compression type system. The terminology should be understood as including any known liquid medium used in such system including synthetic liquid lubricants.

The present invention also envisages a compressor system including one or more of the aforementioned valving aspects, or any novel feature or group of novel features evident from the following description of a preferred embodiment given in relation to the accompanying drawings. In the accompanying drawings.

Figure 1:
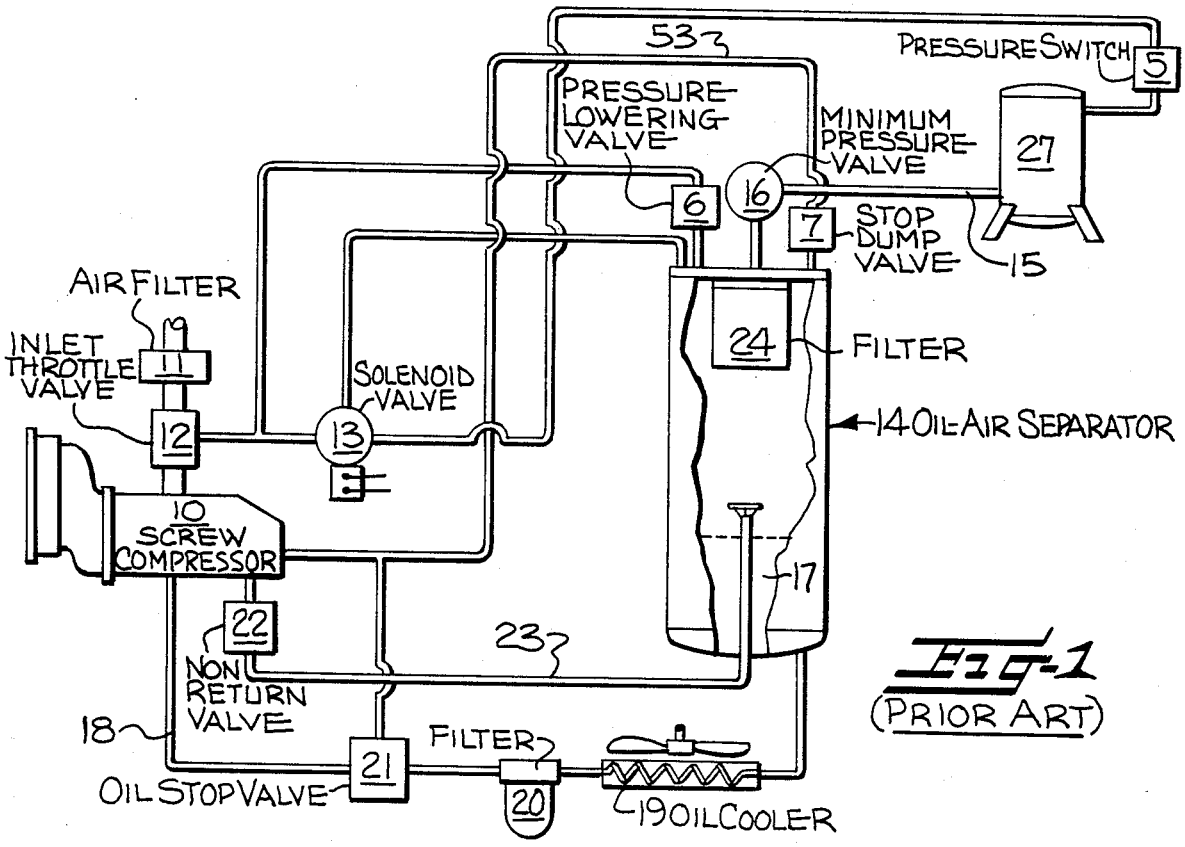
Fig-1 (PRIOR ART)
FIG. 1 is a schematic flow diagram of a conventional screw compressor system.

The conventional compressor system shown in FIG. 1 comprises a screw compressor 10 receiving air (or some other appropriate gas) via an air filter 11 and an inlet throttle valve 12. In addition oil is supplied via the line 18 to the inlet region of the compressor 10 to be intimately mixed and compressed with the air and discharged via a non return valve 22 and line 23 to an oil/air separator vessel 14. In the separator 14 oil is separated from the air and is recycled to the compressor 10 via line 18, cooler 19, filter 20 and the oil stop valve 21. Clean air is discharged from the separator 14 via the final filter element 24, a minimum pressure valve 16, and a discharge line 15 to end use represented schematically by vessel 27. A pressure switch 5 is provided associated with the vessel 27 which is operative in response to the air use in the system which affects the discharge pressure from the separator 14. Control of the air inlet throttle 12 to the compressor 10 may be effected by actuating means (such as an air cylinder not shown) and solenoid 13 when the system discharge pressure reaches a preset maximum and as a result the throttle valve 12 is closed. The reverse occurs when the system discharge pressure falls to a lower preset level. The system illustrated further includes a stop dump valve 7 provided in a line leading from the separator 14 to enable the dumping of all pressure from the system after the compressor has been shut down. Finally, a pressure lowering valve 6 with an integral non return valve may also be provided in a line leading from the separator 14 to the inlet throttle valve 12. The operation of the valve 6 is intended to reduce the back pressure against which the compressor operates to reduce the compression ratio of the compressor during unloaded operation. The various modes of operation and problems associated with this conventional arrangement are discussed in the introduction to this specification and are therefore not further referred to here.

Figure 2:
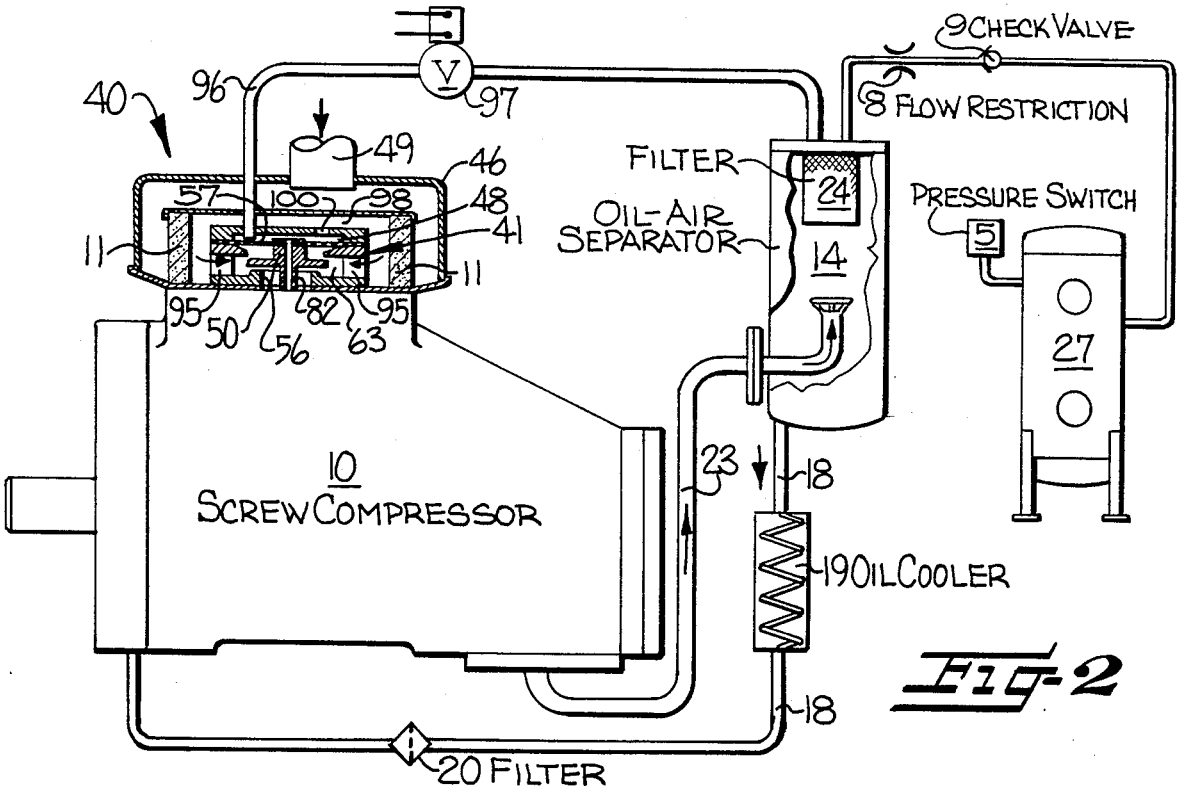
FIG. 2 is a schematic flow diagram of a screw compressor system employing a simplified valve arrangement according to a first preferred embodiment of the present invention.
Figure 3:
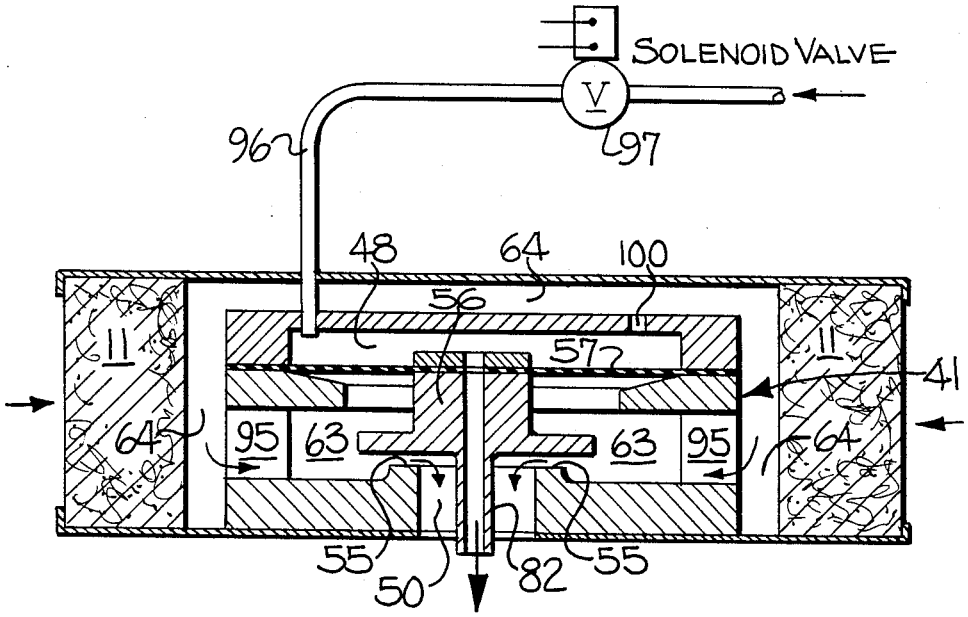
FIG. 3 is a more detailed cross-sectional view of the valve arrangement drawn in FIG. 2.

Referring now to FIGS. 2 and 3 there is shown both a modified compressor system and a first embodiment of a valve arrangement employed in the system according to a first preferred arrangement of the present invention. The system illustrated in FIG. 2 is essentially similar to that of FIG. 1 except that a simple and single valve arrangement 40 is provided in the air inlet region to the compressor and the complicated and expensive oil stop valve 21 in the oil return line 18 and the non return valve 22 in the discharge line 23 are omitted. As a result the system is less complicated. Referring to both FIGS. 2 and 3 the construction of one possible form of valve configuration 40 is shown. The valve configuration includes an air filter 11 of annular construction within an outer protective casing 46 having an inlet 49 to receive ambient air. It will of course be appreciated that any other compatible gas requiring compression might be used and further the gas need not be at ambient pressure. A chamber 64 is thus defined within the air filter 11 and generally surrounding the inlet passage 50 leading to the inlet region of the compressor 10.

Interposed between the inlet passage 50 and the chamber 64 is a valve element comprising a fixed body portion 41 defining a valve seat 55 surrounding the compressor inlet passage 50 and a movable valve member 56 supported by a flexible diaphragm 57. The valve member 56 is disposed within a chamber located within the fixed body portion 41 and upon flexing of the diaphragm 57, acts to close or open the valve seat 55. The disphragm 57 divides the chamber into an upper zone 48 and a lower zone 63. The lower zone 63 is in open communication via openings 95 in the wall of the body portion 41 with the chamber 64. The upper zone 48 is in communication with line 96 via a solenoid valve 97 with the clean pressurized air zone of the separator 14. Although a solenoid valve 97 is preferred, other valve arrangements might also be used. The zone 48 is further in communication with the chamber 64 via a restricted passage 100 in the upper wall of the valve body portion 41. Finally a drop tube 82 of restricted passage width communicates the compressor inlet passage 50 with the zone 48.

Operation of the valve arrangement first described will not be briefly described. At start-up, the valve member 56 freely rests against the valve seat 55 to close the compressor inlet 50. Consequently, when the compressor commences operation, a vacuum condition is rapidly developed at the inlet passage 50 which is communicated via the drop tube 82 to the zone 48. However, since the area of the diaphragm 57 against which the vacuum acts is much larger in zone 48 than the area of the member 56 affected by the vacuum in the compressor inlet 50, the member 56 is moved upwardly establishing air flow from chamber 64 through the openings 95 to the compressor inlet passage 50. When the discharge pressure (sensed for example by a pressure switch 5) reaches a preset valve, the solenoid valve 97 is opened such that pressurized air flows via line 96 to the chamber 48 and the valve member 56 is closed. This stops the main flow of ambient air to the compressor 10, however, to avoid the problems of noise associated with conventional systems some air is injected via the drop tube 82 into the compressor inlet passage 50 as the valve member 56 is closed against the seat 55. At the same time some air will also flow through the opening 100 thereby acting as a pressure lowering valve. The opening 100 should be sized less than the opening through the drop tube 82 such that more gas may be withdrawn from the zone 48 than let in via the opening 100. When the discharge pressure has again dropped to a lower preset level, the solenoid valve 97 is then closed thus re-establishing vacuum conditions in chamber 48 and inlet passage 50 and opening the valve seat 55. This cycle continues to operate until the machine is shut down.

At shut-down, the normally energized solenoid valve 97 opens closing the valve member 56 against the seat 55 and injecting air into the compressor to prevent reverse running. The separator 14 is blown down via the line 96, zone 48 and the opening 100 in the valve body 41 to atmosphere.

Figure 4:
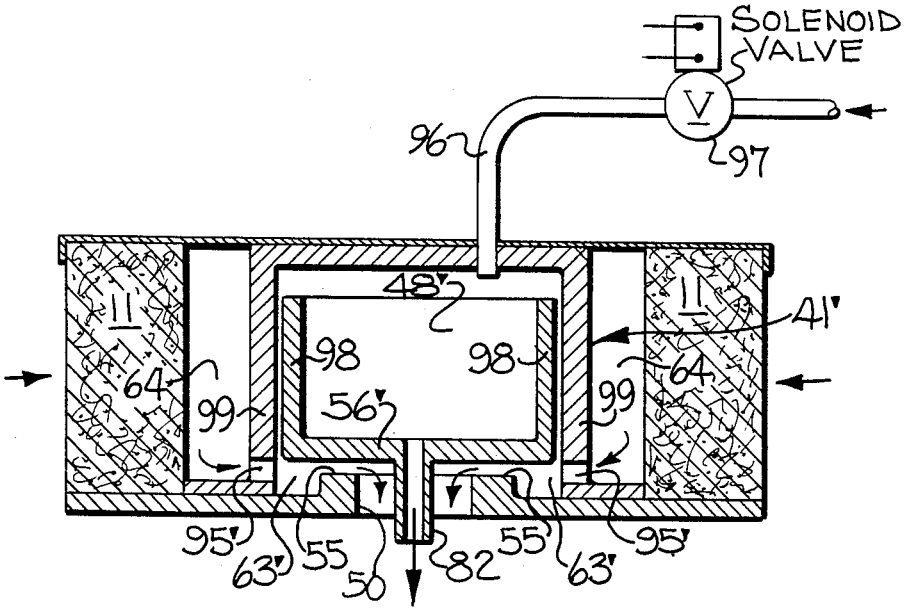
FIG. 4 is a second alternative form of valve arrangement suitable for use in the system shown in FIG. 2.

FIG. 4 illustrates a possible alternative and simplified valve construction for carrying out essentially similar functions to the valve arrangement shown in FIG. 3. Like features have been given the same reference numerals. In this embodiment the valve construction comprises a fixed valve body 41' in the form of an inverted U in cross-section generally surrounding the compressor inlet passage 50. Openings 95' are provided in the lower periphery of the valve body 41' giving free communication between the chamber 64 and the zone 63' within the body 41' immediately adjacent the inlet passage 50. Arranged within the valve body 41' is a piston member 56′ having walls 98 in close sliding arrangement with the walls 99 of the valve body 41. A clearance fit of about 0.005 inches is considered satisfactory. A drop tube 82 provides restricted communication from the zone 48′ above the piston member 56′ to the compressor inlet passage 50.

The arrangement of FIG. 4 functions in an essentially similar manner to that of FIG. 3. At start-up the piston member 56′ rests against the valve seat and closes the passage 50. In this condition the vacuum created by the compressor 10 at passage 50 is communicated via the tube 82 to the zone 48′ and again because of the difference in active areas the piston 56′ lifts admitting air to the compressor. When the desired system pressure is reached the solenoid valve 97 is activated communicating pressurized air to the zone 48′ thereby closing the piston member 56′ against the valve seat 55. Simultaneously the pressurized air is supplied via the drop tube 82 to the compressor inlet to reduce the effective compression ratio of the compressor and thereby reduce noise levels. Some air will also tend to flow between the valve body walls 99 and the piston walls 98 this performing the function of a pressure lowering valve. When the system pressure has dropped to a preset level the solenoid valve is deactivated closing the line 96 and the piston member 56′ lifts again admitting air to be compressed. Under normal operating conditions this cycle continues until the machine is shut down.

At shut down, as with the embodiment of FIG. 3, the solenoid valve 97 is opened thereby closing the piston member 56′ against the seat 55. Compressed air is injected into the compressor via the drop tube 82 to prevent reverse running of the compressor. The separator tank 14 is blown down through the gap between the piston walls 98 and the valve body walls 99.

The piston member 56′ of FIG. 4 and the equivalent diaphragm and valve member 56, 57 of FIG. 3 may advantageously be constructed in a light weight manner by using light metals and by being constructed in an essentially hollow manner, possibly using metal spinning techniques. In consequence the valve piston member 56′ and the diaphragm and valve member 56, 57 will have a very low inertia and when pressure falls in the zone 48, 48′ (upon closing of the solenoid valve 97), the valve member 56, 56′ will lift very quickly thereby minimizing the period of time for the compressor ratio to rise and cause excessive noise.

Should the solenoid valve 97 fail to close, the valve will close due to the differential active areas between the zone 48, 48′ and the passage 50 and a slow back flow may occur through the gap causing slow reverse running of the compressor at shut down. This may be avoided by providing a back-up solenoid valve and is a disadvantage of this configuration.

Figure 5:
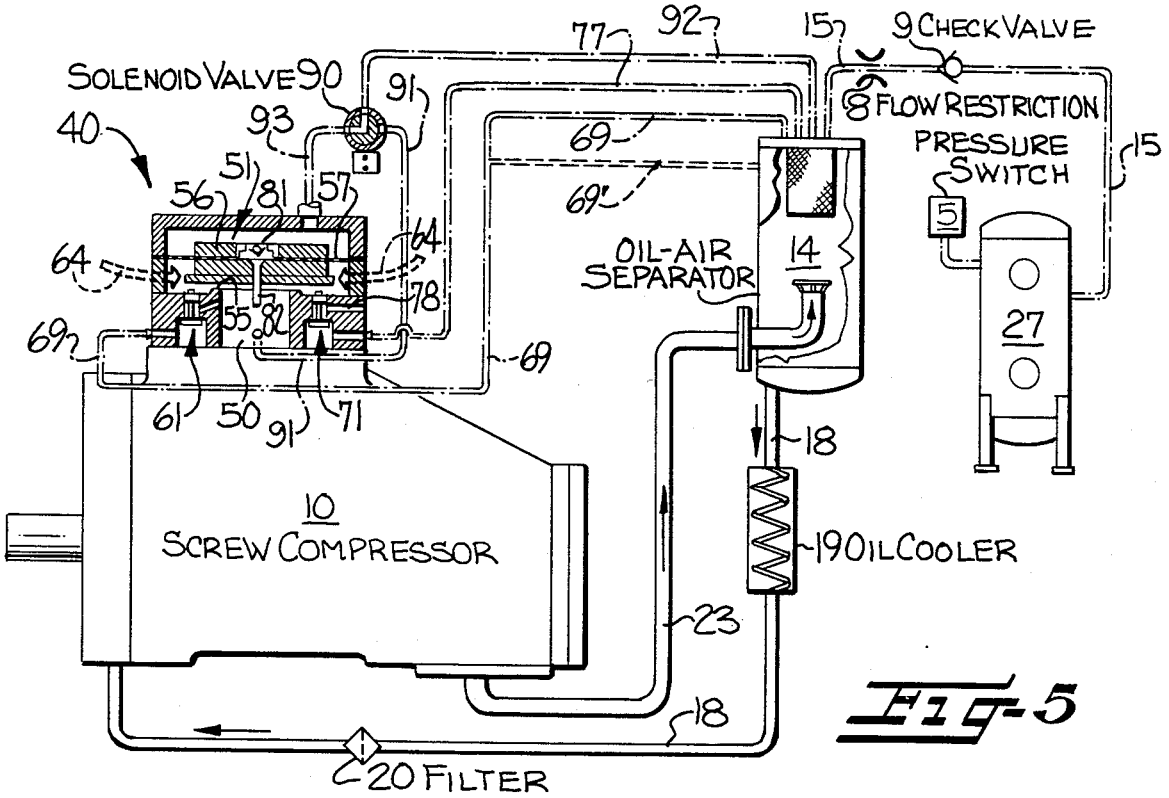
FIG. 5 is a schematic flow diagram of a screw compressor system similar to FIG. 2 employing a third alternative form of valve arrangement in accordance with the present invention.
Figure 6:
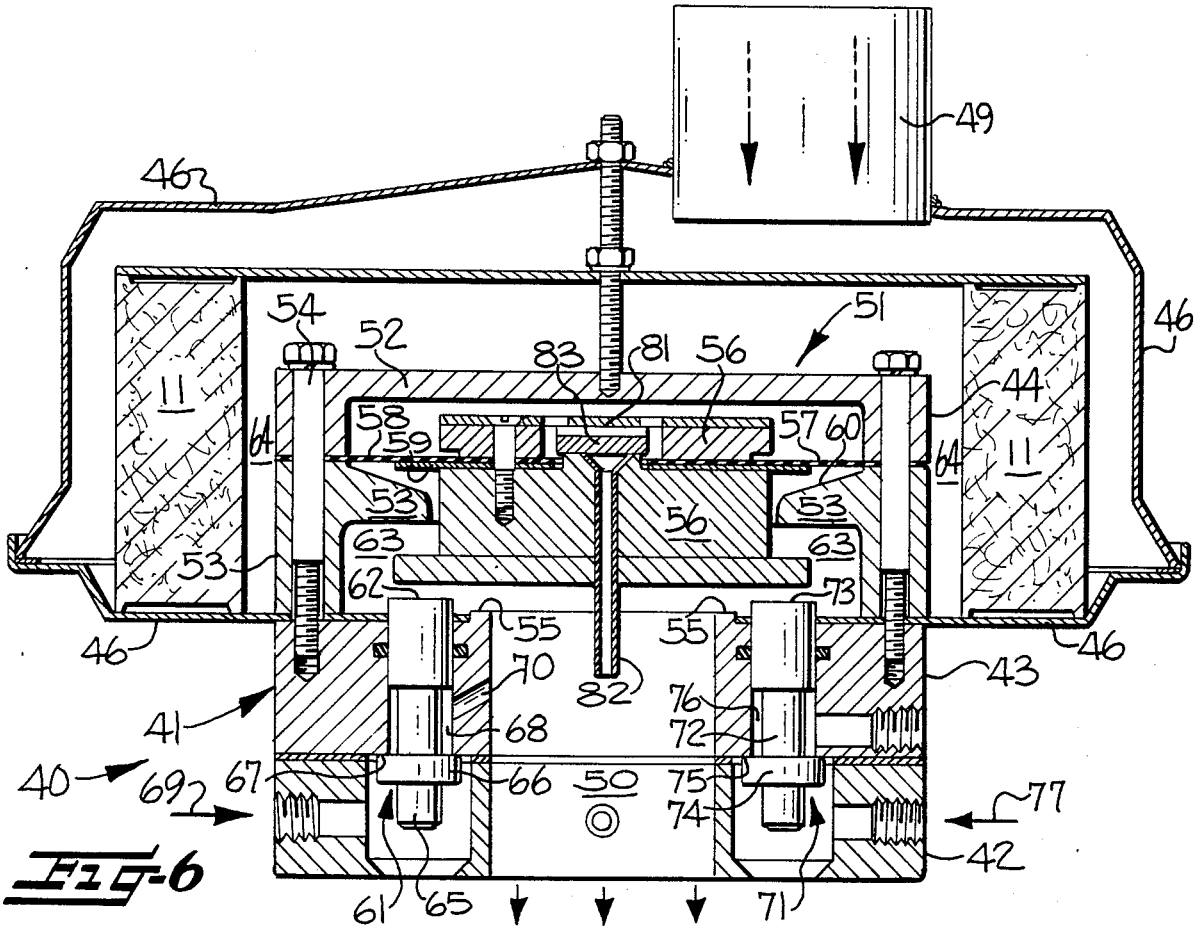
FIG. 6 is a cross-sectional detail view of the valve configuration illustrated generally in FIG. 5.

FIGS. 5 and 6 illustrate a somewhat more complex configuration which is relatively more effective. Again like reference numerals identify similar features to those described in preceding embodiments. FIG. 6 is a detailed cross-sectional view of the valve construction illustrating a valve body 41 comprising a lower section 42 and intermediate section 43 and an upper section 44. The upper section 44 is generally surrounded by a protective enclosure 46 having a lower tray supporting an annular air filter 11 and an upper cap member having an atmospheric air inlet passage 49. The lower and intermediate sections 42, 43 of the valve body have a central co-axial airflow passage 50 forming an inlet passage to the air inlet region of the compressor 10.

A first valve means 51 is mounted generally within the air filter 11 and over the air flow passage 50 to the compressor whereby the valve means 51 opens or closes air flow via the filter 12 from the inlet passage 49 to the air inlet region of the compressor 10. The first valve means 51 is constructed within the upper section 44 and comprises an upper body part 52 and a lower body part 53, each secured by bolt means 54 to the intermediate valve section 43. The lower body part 53 has access openings communicating the chamber 64 within the filter 11 with the zone 63 within the body parts 52 and 53. An annular upraised valve seat 55 surrounds the air flow passage 50 and a first valve element 56 is arranged within the body parts 52 and 53 such that it is movable to a position contacting the seat 55 which defines the closed position of the first valve means 51. The first valve element 56 is secured by a diaphragm 57 secured around its periphery between the upper and lower body parts 52 and 53. The diaphragm itself is constructed preferably in two parts such that an upper complete diaphragm part 58 is the normally functional element, but a second more rigid part 59 of smaller diameter is provided to engage against and seal with a frusto conical seat 60 formed integrally with the lower body part 53.

Arranged within the lower and intermediate sections 42 and 43 of the valve configuration is a second valve element 61. The second valve element 61 comprises a spool valve 65 having an upper projection 62 extending into the cavity 63 immediately beneath the first valve element 56. The length of the projection 62 into the cavity 63 exceeds the height of the valve seat 55 whereby the projection 62 is contacted by the valve element 56 before the element engages against the valve seat 55. The spool valve 65 includes a second valve part 66 which is adapted to engage a second valve seat 67 arranged within a first communication passage 68 in the valve sections 42 and 43. The communication passage 68 is arranged to connect the clean air region of the separator 14 via line 69 to the inlet passage 50 to the compressor via a port opening 70. In certain circumstances the line 69 might be replaced by line 69′ taking slightly oily air for return to the inlet passage 50.

A third valve element 71 comprising a spool valve 72 of essentially similar construction to the second valve element 61 is provided in the lower and intermediate valve sections 42 and 43. The spool valve 72 includes a projection 73 which will be engaged by the valve element 56 at about the same time as the projection 62 of spool valve 65 is engaged. The spool valve 72 also includes a valve part 74 which is adapted to engage a valve seat 75 arranged within a second communication passage 76 in the valve sections 42 and 43. The second communication passage 76 is arranged to connect the clean air region of the separator 14 via line 77 to atmosphere through the port 78.

Finally a fourth valve element 81 is provided including a drop tube 82 joining the passage 50 with the upstream side of the diaphragm 57 and an upper valve member 83 normally closing the upper end of the tube 82.

The following provides a description of the operation of valving configuration of FIGS. 5 and 6. Due to the weight of the valve element 56, and its position at the end of a previous operating cycle, the valve element is at start-up resting closed against the valve seat 55. On starting of the compressor 10 a vacuum is formed in the inlet passage 50 and acts on the underside of the valve element 56 drawing it down firmly into the closed position. The compressor 10 thus starts unloaded (i.e. with the inlet closed). This inlet vacuum is also communicated via line 91 to a controlling solenoid valve 90 which is de-energized and closes the line 91. At the same time the solenoid 90 is communicating the separator pressure (atmospheric at start-up) via the lines 92, 93 onto the top of the diaphragm 57. After full speed is attained a timer or similar system energizes the solenoid 90 and the solenoid switches over closing off the separator pressure and communicating the vacuum on the underside of the diaphragm in passage 50 with the volume on top of the diaphragm 57 by connecting lines 91 and 93. Due to the large area of the diaphragm 57 and the atmospheric pressure on its underside, combined with the reduced pressure on its upperside, the valve element 56 lifts away from the seat 55. When the throttle or first valve 51 opens the vacuum disappears but the dynamic pressure drop of the inlet air across the valve is sufficient when combined with the large area of the diaphragm 57 to maintain it in the open position. When the system pressure reaches a pre-set level determined by a pressure switch 5, the solenoid 90 is de-energized and the separator pressure is communicated to the top of the diaphragm 57 thereby closing the valve element 56 against the seat 55. Just prior to this the auxilliary or second and third valves 61 and 71 are actuated. The second valve 61 injects air from the separator into the compressor inlet while the third valve acts as a pressure lowering valve reducing the separator pressure to reduce the unloaded power consumption and also dumping oil free air to atmosphere. The injection of air into the inlet 50 underneath the valve element 56 increases the inlet pressure during unloaded running. This substantially reduces the compression ratio and eliminates the transient noise described earlier. As the separator pressure falls (due to the action of the third valve 71 so too does the driving force pushing air into the inlet 50). Hence as the separator pressure falls, so too does the volume of injected air and the power consumption is therefore less than with a large injected air volume achieved by a large air bleed passage across the main throttle valve as used in conventional systems. The noise does not re-appear because the separator pressure is now low, the compression ratio having remained substantially constant during the unloading cycle. With this system a maximum amount of air is injected into the inlet 50 (i.e. to highest inlet pressure) at the time of transient noise (i.e. peak compression ratio) at all other times the volume and power consumption are less.

When the pressure switch 5 senses a requirement for more air the solenoid 90 is energized, closing off the pressure from the separator 14 via line 92 and communicates the upper and lower sides of the diaphragm valve means 56,57 via lines 91,93 thereby reopening the valve means 56,57. This cycle continues while the compressor system continues to operate.

On stopping the compressor system, the solenoid 90 is de-energized and admits air onto the top of the diaphragm 57. This closes the valve means 56,57 and as before the inertia of the solenoid and the valve element 56 is slight and closes quickly, whilst the compressor 10 continues to run-on for some time. This ensures the main valve means 51 is closed well before the compressor 10 stops and flow reversal can occur. As the valve element 56 closes it actuates the second and third auxilliary valves 61 and 71. The valve 61 injects air in to the compressor 10, which is slowing down, and continues to do so after the compressor stops. Instead of a flow reversal being required, the compression chamber of the compressor is charged on run down and is full of pressure to resist any reversal. Furthermore, the existence of this air in the compression chamber prevents oil being injected into the compression space, which would flood the compressor and make restarting very difficult.

The most likely failure that might occur is a rupture of the diaphragm or a failure of the solenoid. By suitably arranging the areas of the diaphragm considerably less pressure is required on top of the diaphragm valve element 56,57 to hold it closed against full pressure on the underside exerted through the inlet passage 50. This would arise if there were a serious leak anywhere on the pressure side of the system, including the diaphragm 57. Should the main diaphragm 58 rupture, the secondary semi rigid diaphragm 59 would seal at its edges against the diaphragm support plate 60 and would offer a completely independant barrier to the actuating air preventing it from escaping to atmosphere and lowering system pressure. The solenoid is so arranged to be normally open so that a power failure or coil burnout will fail safe with separation pressure directed on to the top of the diaphragm 56,57. Should the solenoid fail in a closed position or the line 93 to the top of the main valve 51 break completely or become disconnected the insert or fourth valve 81 will operate. The compressor will stop rotating and start to reverse. The drop tube 82 will convey this pressure up through the valve body 56 opening the valve member 83 admitting air on to the top of the diaphragm 56,57. Due to the greater area of the diaphragm 56,57 over the valve body 56 the valve body is brought closed against the seat 56. Suitable port sizing ensures that the volume supplied by the safety system is in excess of that which may be lost down the disconnected inlet line. If any other line breaks or becomes disconnected the main valve 51 will not open and as such system pressure cannot be built up, and therefore, stopping presents no serious problem. A further advantage of the present valving arrangement is the elimination of a second transient noise that occurs when the compressor unloads only for a short time. For example, if the anti noise air was to be regulated by, for instance, a remote valve operating in parallel with the controlling solenoid 90, this valve would open and close at slightly different times to the main valve 51, due to inertia and pressure effects. Should the anti noise air be supplied too late or cut off too soon the compressor would experience a high compression ratio and hence noise would result. This can and does occur in practice, particularly on short unloading cycles (where the separator 14 has not yet dumped and anti noise air is still needed). Synchronization of the two valves in such an arrangement is complex and difficult. These problems do not occur with the valving configuration in accordance with the present invention. In the present arrangement the anti noise air supplied via valve 61 is mechanically operated from the main valve element 56 and so its timing is fixed to admit air just slightly prior to the main valve 51 closing and similarly until just after the main valve 51 has opened.

Furthermore the valving arrangement according to the present invention avoids the need for an expensive minimum pressure valve 16 as with the conventional system and this valve may be replaced by a simple flow restrictor 8 and a one way valve 9.

We claim:

1. A valve configuration for a gas inlet of a compressor, said valve configuration comprising:

a first valve seat defining a gas flow opening, said gas flow opening being adapted to communicate with a gas flow passage leading to the gas inlet of the compressor;

a first valve means co-operable with said first valve seat to open or close said gas flow opening, said first valve means having a first face directed towards said first valve seat and a second face directed away from said first valve seat;

a first zone separate from said gas flow passage arranged adjacent to said second face of said first valve means whereby pressure conditions in said first zone are applied over an effective area of said second face greater than the area of said gas flow opening;

first communication means adapted to communicate pressure conditions in said gas flow passage to said first zone whereby vacuum conditions existing in said gas flow passage communicated to said first zone effects movement of said first valve means fully away from said first valve seat;

second communication means adapted to selectively supply gas at a predetermined pressure to said first zone to establish a pressure differential across said first valve means towards said first valve seat to thereby effect closure of said first valve means against said first valve seat; and pressurized gas supply means adapted for communication with the gas inlet of the compressor when said first valve means is initially engaged against said first valve seat to close said gas flow opening thereby reducing vacuum conditions in said gas inlet of the compressor.

2. A valve configuration according to claim 1 wherein first valve means comprises a movable first valve member supported by a flexible diaphragm with the second face of said first valve means being formed by an upwardly facing surface of said first valve member and said flexible diaphragm.

3. A valve configuration according to claim 2 wherein said first communication means comprises passage means extending through said first valve means.

4. A valve configuration according to claim 3 wherein said passage means includes a tube forming an extension thereof and extending from said first valve element into said gas flow passage.

5. A valve configuration according to claim 1 wherein said pressurized gas supply means includes a second valve means, said second valve means being activated by said first valve means moving towards said first valve seat to connect the gas inlet of the compressor with a source of pressurized gas.

6. A valve configuration according to claim 5 wherein said second valve means includes a spool valve element contactable by said first valve means prior to said first valve means engaging against said first valve seat to open said spool valve element, thereby connecting the source of pressurized gas to the inlet region of the compressor, said spool valve element being held open by said first valve means engaged against said first valve seat.

7. A valve configuration according to claim 1 further including a valve arrangement arranged to connect a pressurized gas region of a separator associated with the compressor to atmosphere and activated by said first valve means upon moving towards said first valve seat.

8. A valve configuration according to claim 7 wherein said valve arrangement comprises a spool valve element contactable by said first valve means, prior to said first valve means engaging against said first valve seat, to open said spool valve element thereby connecting said pressurized gas region of the separator with atmosphere, said spool valve element being held open by said first valve means engaged against said first valve seat.

9. A valve configuration according to claim 1 further including a valve arrangement in said first valve means adapted to communicate a pressure in said gas flow passage to said first zone only when the pressure in said gas flow passage exceeds the pressure in said first zone by a predetermined amount.

10. A valve configuration according to claim 9 wherein said valve arrangement includes passage means extending through said first valve means and a tube element extending said passage from said first valve means a predetermined distance into said gas flow passage.

11. A valve configuration according to claim 2 wherein said first valve means includes a further valve structure having a radially inwardly projecting ledge surrounding said first valve means; and wherein said diaphragm comprises first and second parts, said first part being connected to said first valve member and extending annularly therefrom to be held by said valve structure surrounding said first valve means, said second part also connected to said first valve member and extending radially therefrom to define a free peripheral edge, said second part being relatively stronger than said first part and said free edge thereof being adapted to engage with and seal against said radially inwardly projecting ledge of said valve structure upon failure of the first part of the diaphragm.

12. A compressor comprising a gas inlet including a gas flow passage, a compressed gas outlet, means for compressing gas passing through said gas inlet and a valve configuration cooperating with said gas inlet, said valve configuration comprising:

a first valve seat defining a gas flow opening, said gas flow opening being adapted to communicate with said gas flow passage;

a first valve means co-operable with said first valve seat to open or close said gas flow opening, said first valve means having a first face directed towards said first valve seat and a second face directed away from said first valve seat;

a first zone separate from said gas flow passage arranged adjacent to said second face of said first valve means whereby pressure conditions in said first zone are applied over an effective area of said second face greater than the area of said gas flow opening;

first communication means adapted to communicate pressure conditions in said gas flow passage to said first zone whereby vacuum conditions existing in said gas flow passage communicated to said first zone effects movement of said first valve means fully away from said first valve seat;

second communication means adapted to selectively supply gas at a predetermined pressure to said first zone to establish a pressure differential across said first valve means towards said first valve seat to thereby effect closure of said first valve means against said first valve seat; and pressurized gas supply means adapted for communication with the gas inlet of the compressor when said first valve means is initially engaged against said first valve seat to close said gas flow opening thereby reducing vacuum conditions in said gas inlet of the compressor.

13. A compressor system comprising a compressor having inlets to receive a gas and a liquid and to mix and compress the gas and liquid, a separator adapted to receive compressed gas and liquid from said compressor, a liquid cooler adapted to receive liquid from said separator and to cool the liquid prior to return of the liquid to said liquid inlet of said compressor, and a valve configuration having a gas flow passage leading to said gas inlet of said compressor, said valve configuration comprising:

a first valve seat defining a gas flow opening, said gas flow opening communicating with said gas flow passage;

a first valve means co-operable with said first valve seat to open or close said gas flow opening, said first valve means having a first face directed towards said first valve seat and a second face directed away from said first valve seat;

a first zone separate from said gas flow passage arranged adjacent to said second face of said first valve means whereby pressure conditions in said first zone are applied over an effective area of said second face greater than the area of said gas flow opening;

first communication means adapted to communicate pressure conditions in said gas flow passage to said first zone whereby vacuum conditions existing in said gas flow passage communicated to said first zone effects movement of said first valve means fully away from said first valve seat;

second communication means adapted to selectively supply gas from a pressurized gas region of said separator to said first zone to establish a pressure differential across said first valve means towards said first valve seat to thereby effect closure of said first valve means against said first valve seat; and third communication means adapted to supply gas from the pressurized gas region of said separator to said gas inlet of said compressor when said first valve means is engaged against said first valve seat to close said gas flow opening thereby reducing vacuum conditions in said gas inlet of the compressor.

14. A compressor system according to claim 13 wherein said second communication means includes a first communication passage leading from said separator to said first zone of said valve configuration; and wherein said valve configuration includes a second valve means operable in response to gas discharge pressure from said system for opening and closing said first passage.

15. A compressor system according to claim 14 wherein said first communication means includes a second communication passage leading from said gas inlet of said compressor to said second valve means, said second valve means being operable to connect either said separator or said gas inlet of said compressor to said first zone of said valve configuration.

16. A compressor system according to claim 14 wherein said first communication means includes a second communication passage extending through the first valve means.

17. A compressor system according to claim 16 wherein said second communication passage includes an extended section leading from said first valve means towards said gas inlet of said compressor.

* * * * *